US005231428A

United States Patent [19]

Domoto et al.

[11] Patent Number: 5,231,428

[45] Date of Patent: Jul. 27, 1993

[54] IMAGING DEVICE WHICH COMPENSATES FOR FLUCTUATIONS IN THE SPEED OF AN IMAGE RECEIVING SURFACE

[75] Inventors: Gerald A. Domoto; Aron Sereny, both of Briarcliff Manor, N.Y.

[73] Assignee: Xerox Corporation, Stamford, Conn.

[21] Appl. No.: 631,354

[22] Filed: Dec. 11, 1990

[51] Int. Cl.[5] ..... G01D 15/06

[52] U.S. Cl. ..... 346/159; 346/1.1; 346/153.1

[58] Field of Search ..... 346/159, 153.1, 1.1; 361/231, 233, 235; 355/255, 221

[56] References Cited

U.S. PATENT DOCUMENTS

| | | | |
|---|---|---|---|
| 3,496,351 | 2/1970 | Cunningham | 355/221 |
| 3,582,711 | 6/1971 | Jahnke | 361/231 |
| 3,725,951 | 4/1973 | McCurry | 346/159 |
| 3,935,517 | 1/1976 | O'Brien | 250/325 |
| 4,228,480 | 10/1980 | Benwood et al. | 361/235 |
| 4,431,302 | 2/1984 | Weber | 355/14 CH |
| 4,463,363 | 7/1984 | Gundlach et al. | 346/159 |
| 4,480,909 | 11/1984 | Tsuchiya | 355/14 CH |
| 4,486,808 | 12/1984 | Cardone | 361/235 |
| 4,498,098 | 2/1985 | Honda et al. | 346/159 |
| 4,524,371 | 6/1985 | Sheridon et al. | 346/159 |
| 4,538,163 | 8/1985 | Sheridon | 346/159 X |
| 4,575,739 | 3/1986 | DeSchamphelaere et al. | 346/160 |
| 4,584,592 | 4/1986 | Tuan et al. | 346/154 |
| 4,644,373 | 2/1987 | Sheridon et al. | 346/159 |
| 4,646,163 | 2/1987 | Tuan et al. | 358/300 |
| 4,737,805 | 4/1988 | Weisfield et al. | 346/159 |
| 4,791,433 | 12/1988 | Mallicoat | 346/1.1 |
| 4,792,860 | 12/1988 | Kuehrle et al. | 346/155 X |
| 4,835,545 | 5/1989 | Mager et al. | 346/1.1 |
| 4,839,670 | 6/1989 | Snelling | 346/153.1 |
| 4,839,671 | 6/1989 | Theodoulou et al. | 346/159 |
| 4,899,186 | 2/1990 | Walcott | 346/159 |
| 4,996,425 | 2/1991 | Hanser et al. | 346/159 X |
| 5,081,476 | 1/1992 | Genovese | 346/159 |

*Primary Examiner*—Benjamin R. Fuller
*Assistant Examiner*—Randy W. Gibson
*Attorney, Agent, or Firm*—Oliff & Berridge

[57] ABSTRACT

Methods and apparatus are provided for forming images on a moving, charge retentive surface using a stream of radiant energy, modulated in imagewise fashion, wherein the intensity of the stream of radiant energy is controlled based on measured variations of the actual speed of the imaging surface from a set speed. In particular, a motion encoder, which is preferably the same motion encoder previously used to control the proper location of each line of information on the imaging surface is used to monitor the actual, instantaneous speed of the imaging surface to produce an actual speed signal. This actual speed signal is compared to a set speed signal to produce a speed variance signal which represents the difference between the actual imaging surface speed and the set speed. The variance speed signal is then used to control the intensity of the stream of radiant energy.

17 Claims, 5 Drawing Sheets

IMAGING DEVICE WHICH COMPENSATES FOR FLUCTUATIONS IN THE SPEED OF AN IMAGE RECEIVING SURFACE

BACKGROUND OF THE INVENTION

1. Field of the Invention

The present invention relates generally to controlling radiant energy deposition in imaging devices which employ moving image receiving surfaces upon which latent images are formed by charging and/or discharging these image receiving surfaces with radiant energy, and more particularly to controlling the intensity of a stream of radiant energy such as, for example, light or ions, which is directed toward the imaging surface to form the latent image so that portions of the image receiving surface are uniformly charged regardless of fluctuations in the velocity at which the image receiving surface is moved relative to a source of the radiant energy (also known as velocity error).

2. Discussion of Related Art

A large number of image forming, or imaging, devices are available which produce a latent image on an image receiving, or imaging, surface by directing a stream of radiant energy, which is appropriately modulated based on the image to be formed, toward the imaging surface. The latent image is then made visible on a copy sheet by suitable development apparatus to form a permanent image on the copy sheet. For example, the imaging surface can be a photoreceptive belt or drum which is uniformly charged and then moved past a stream of light, the intensity of which is imagewise modulated, to form the latent image thereon. The light can be modulated, for example, by reflection off an original document (which contains dark and light portions based on the image contained thereon), or by providing a plurality of light sources (such as LED's) which are individually addressed with data representing an image so that they selectively emit or do not emit light towards the photoreceptive surface. In either case, the light which reaches portions of the photoreceptive surface causes the charge on these portions to dissipate to a varying degree based upon the intensity of the light and the duration of its exposure onto that portion of the photoreceptive surface. Similarly, an ionographic imaging device directs a modulated stream of ions towards a moving electroreceptive surface (such as, for example, a drum or belt) to selectively charge portions of the electroreceptive surface in imagewise fashion. The darkness of the images formed on the copy sheet depends on the density of the ion stream and the duration of its exposure onto portions of the electroreceptive surface receiving that image.

Thus, in imaging devices which direct a stream of radiant energy toward a moving imaging surface, the amount of charge which is applied to, or removed from, the imaging surface is related to the speed at which the imaging surface is moved. While it is preferred to maintain the speed of the imaging surface at a constant set speed, and while over time the speed of the imaging surface can, in general, be maintained constant, the actual speed tends to fluctuate and thus, at any instantaneous moment, varies from the set speed. These speed fluctuations can cause inconsistencies in the line-by-line quality, size and darkness of the formed images. These speed fluctuations can be caused by, for example, fluctuations in the input power to the imaging device as well as "gear chatter" in the drive train which moves the imaging surface. Even in systems which selectively operate at more than one set speed, and thus take account of the different possible selected speeds, fluctuations in the actual speed of the imaging surface from the selected set speed results in the same type of inconsistencies in the print quality, etc.

Imaging systems have been introduced which take account of fluctuations in imaging surface speed to partially compensate for the inconsistencies caused thereby. For example, it is known to monitor the position of the imaging surface (e.g. by using a rotary motion encoder) and to control the output of data by an image bar (which forms the latent image on the imaging surface) so that characters are formed at the proper locations on the imaging surface. This process is also known as "reflex printing" and assists in forming characters at the proper locations on the imaging surface. See, for example, U.S. Pat. Nos. 4,575,739 to De Schamphelaere et al, 4,839,671 to Theodoulou, et al and U.S. Pat. No. 5,081,476 to Genovese, which is assigned to the same assignee as the present application.

While the above systems ensure that each new line of information is started at the correct time, any velocity error in the imaging surface velocity will cause a variation in delivered radiant energy (e.g., light intensity to a photoreceptor or ion density to an electroreceptor) that may result in a perceptible error. That is, since the above systems maintain the intensity of the stream of radiant energy which is directed to the imaging surface constant, the stream of energy will be exposed to the imaging surface for different amounts of time depending on the instantaneous speed of the imaging surface, causing different amounts of charging or discharging of the imaging surface to occur at these different speeds. Perceptible differences, or error, in the darkness of the characters in the resulting image has been shown to be particularly evident in low-to-medium density images made with continuous-tone ionography. The same problem would occur in many photon driven continuous-tone methods.

While the above referenced U.S. Pat. No. 5,081,476 to Genovese recognizes that "reflex printing" alone does not fully compensate for all of the inconsistencies caused by speed fluctuations, that application does not fully eliminate all of the inconsistencies mentioned above. The Genovese application controls the time period during which a stream of ions is permitted to flow towards the imaging surface at each line of information so that this time period is constant at each line of information regardless of any fluctuations in the speed of the imaging surface. Gating electrodes are used to selectively permit or block the flow of a modulated stream of ions towards an imaging surface. Thus, the device disclosed by Genovese ensures that substantially equal amounts of energy are applied to the imaging surface at each line of information. However, since the velocity of the imaging surface may be different at each of these lines of information (due to the above-described velocity fluctuations), different amounts of charge are applied to each unit area of the imaging surface and, thus, the resulting darkness of the final output image is not uniform.

U.S. Pat. No. 3,496,351 to Cunningham, Jr. discloses a corona control circuit for controlling the charging of a photoreceptive drum. Images are formed on the drum by rotating the drum in stepwise fashion and applying a light image, one line at a time, to the drum each time the drum is stopped. Cunningham, Jr. recognizes that the duration of the stopped time (known as the dwell time) decreases at higher imaging speeds and that the charging of the drum must be controlled in relation to the dwell time so that the drum is uniformly charged. Accordingly, the intensity of the charge applied to the drum is increased at shorter dwell times and decreased at longer dwell times based on the selected imaging speed. However, Cunningham, Jr. does not compensate for velocity fluctuations from a set speed (i.e., the selected imaging speed) and thus does not measure or compensate for differences between the actual speed of an imaging surface and a set speed. The intensity of the energy stream which exposes the imaging surface to intelligible, imagewise information is also not controlled.

U.S. Pat. No. 4,431,302 to Weber discloses a system which compensates for differences between the actual current flow and the desired current flow from a corona charging electrode which charges an electrochargeable medium by varying the speed of the electrochargeable medium. As with Cunningham, Jr., Weber recognizes the general relationship between the intensity of an energy stream and the speed of an imaging surface which is charged by this energy stream but Weber does not teach or suggest the present invention. In fact, Weber apparently assumes that the imaging surface speed can be precisely controlled or that fluctuations in the imaging surface speed are inconsequential.

U.S. Pat. Nos. 3,935,517 to O,Brien and 4,480,909 to Tsuchiya also disclose the general relationship between energy stream intensity and imaging surface velocity required to achieve uniform charging of the imaging surface, but do not teach or suggest the present invention. All the patents and patent applications cited are incorporated by reference herein.

Xerox Corp. U.S. Pat. Nos. 4,584,592 to Tuan et al, 4,646,163 to Tuan et al, 4,524,371 to Sheridon et al., 4,463,363 to Gundlach et al., 4,538,163 to Sheridon, 4,644,373 to Sheridan et al., and 4,737,805 to Weisfield et al. disclose typical ionographic imaging devices including ionographic head construction, modulation circuitry, and ionographic device architecture, and are herein incorporated by reference.

OBJECTS AND SUMMARY OF THE INVENTION

It is an object of the present invention to provide methods and apparatus for forming images having uniform image quality, even at low and medium image densities.

It is another object of the present invention to provide methods and apparatus for controlling the intensity of a stream of radiant energy which is modulated in imagewise fashion and directed toward a moving charge retentive imaging surface so that the imaging surface is uniformly affected by the stream of energy regardless of fluctuations in the instantaneous speed of the imaging surface from a set speed.

To achieve the foregoing and other objects, and to overcome the shortcomings discussed above, methods and apparatus are provided for forming images on a moving, charge retentive surface using a stream of radiant energy, modulated in imagewise fashion, wherein the intensity of the stream of radiant energy is controlled based on measured variations of the actual speed of the imaging surface from a set speed. In particular, a motion encoder, which is preferably the same motion encoder previously used to control the proper location of each line of information on the imaging surface, is used to monitor the actual, instantaneous speed of the imaging surface to produce an actual speed signal. This actual speed signal is compared to a set speed signal to produce a speed variance signal which represents the difference between the actual imaging surface speed and the set speed. The variance speed signal is then used to control the intensity of the stream of radiant energy.

In imaging devices which form latent images on a photoreceptive imaging surface, for example, the intensity of a stream of light which is directed toward the imaging surface is controlled. In ionographic imaging devices, which direct a stream of ions, modulated in imagewise fashion, toward an electroreceptive surface, the density of the ion stream is controlled, or varied, based on velocity fluctuations in the imaging surface.

BRIEF DESCRIPTION OF THE DRAWINGS

The invention will be described in detail with reference to the following drawings in which like reference numerals refer to like elements and wherein.

DETAILED DESCRIPTION OF THE PREFERRED EMBODIMENTS

Figure 1:
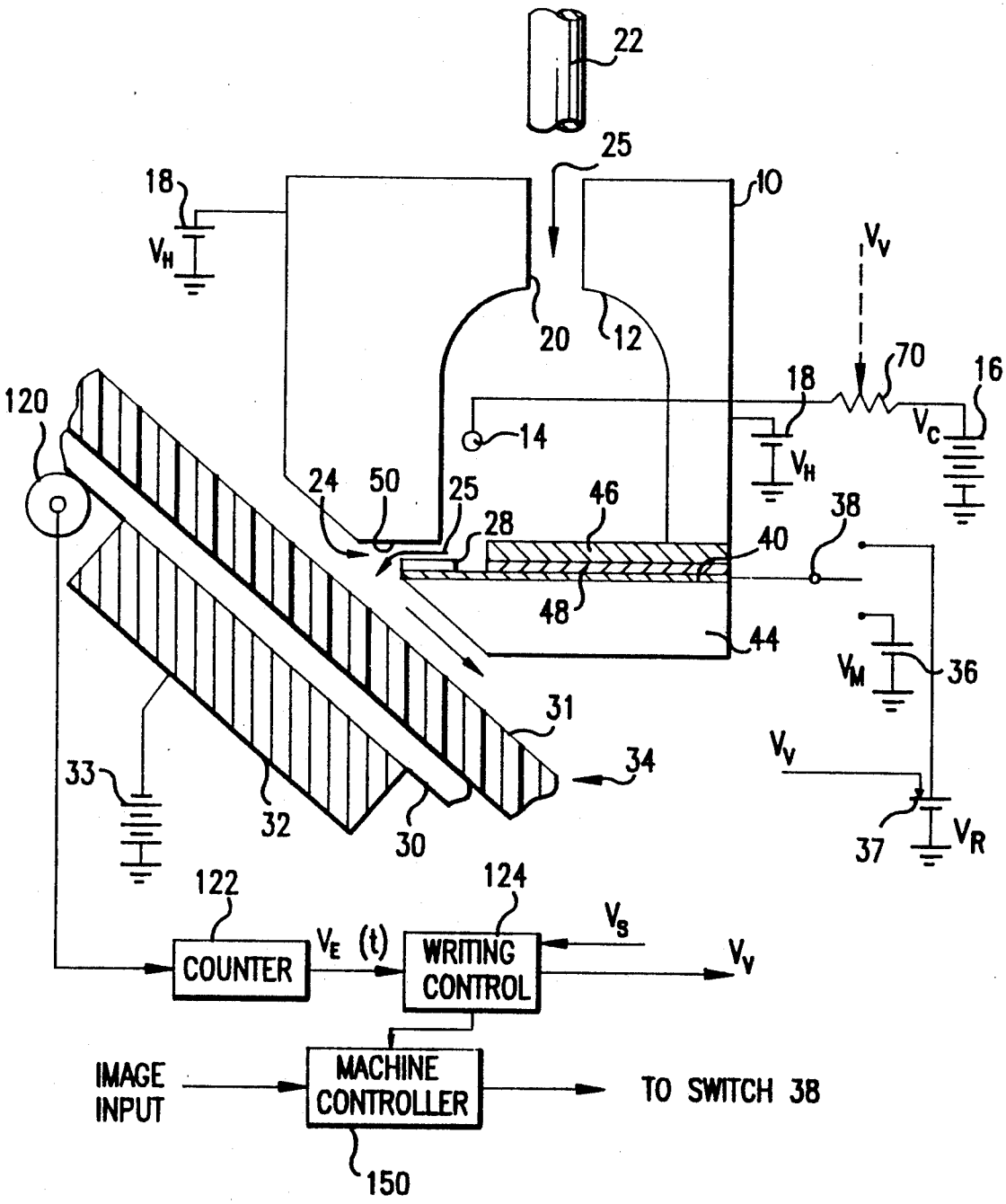
FIG. 1 schematically shows an ionographic printhead of the type contemplated for use with the present invention, in printing relationship with an imaging surface.

With reference now to the drawings where the showings are for the purpose of illustrating an embodiment of the invention and not for limiting same, FIG. 1 shows a schematic representation of a cross section of the marking head 10 of a fluid jet assisted ionographic marking apparatus similar to that described in commonly assigned U.S. Pat. No. 4,644,373 to Sheridan et al.

Within head 10 is an ion generation region including an ion chamber 12, a coronode 14 supported within the chamber, a high potential source 16, on the order of several thousand volts D.C. maintaining coronode 14 at voltage $V_c$, applied to the coronode 14, and a reference potential source 18 (which may be ground), connected to the wall of chamber 12, maintaining the head at a voltage $V_H$. The corona discharge around coronode 14 creates a source of ions of a given polarity (preferably positive), which are attracted to the chamber wall held at $V_H$, and fill the chamber with a space charge.

An inlet channel 20 to ion chamber 12 delivers pressurized transport fluid (preferably air) into chamber 12 from a suitable source, schematically illustrated by tube 22. A modulation channel 24 conducts the transport fluid out of the chamber from ion chamber 12 to the exterior of the head 10. As the transport fluid passes through ion chamber 12, it entrains ions and moves them into modulation channel 24, over an array of ion modulation electrodes 28, each extending in the direction of fluid flow. The interior of ion chamber 12 may be provided with a coating that is inert to the highly corrosive corona byproducts produced therein. In order to increase ion efficiency at the modulation channel 24, various arrangements providing differential biasing of the interior surface of ion chamber 12 have been proposed.

Once the ions in the transport fluid stream come under the influence of a modulation electrode, they may be viewed as individual "beams" which may be allowed to pass to surface 31 or to be suppressed within outlet channel 24 to be described below. Ions allowed to pass out of head 10, through modulation channel 24, and directed to charge receptor 34, come under the influence of a conductive plane 30, provided as a backing layer to a charge receptor dielectric surface 31, with conductive plane 30 slidingly connected via a shoe 32 to a voltage supply 33. Alternatively, a single layer dielectric charge receptor might be provided, passing a biased back electrode to the same effect. Subsequently the latent image charge pattern may be made visible by suitable development apparatus (not shown), and then transferred to a final image sheet. Alternatively, the final image sheet (e.g. a sheet of paper) can have the charge pattern deposited and developed directly thereon. See, for example, the above-incorporated U.S. Pat. No. 4,737,805.

Figure 3:
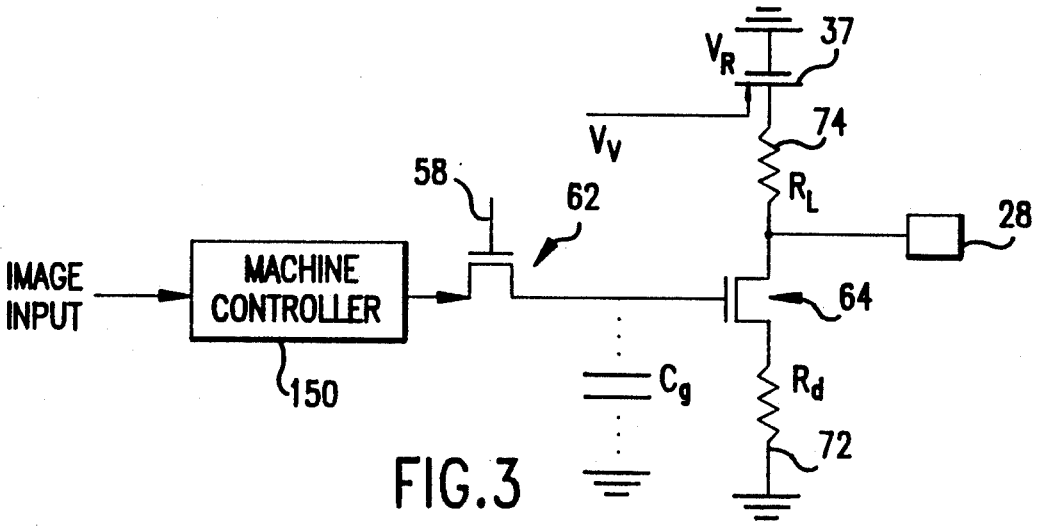
FIG. 3 schematically shows an embodiment of the invention in an ionographic printhead in which modulating electrodes can provide grey levels by having a continuously variable voltage signal applied thereto.
Figure 4:
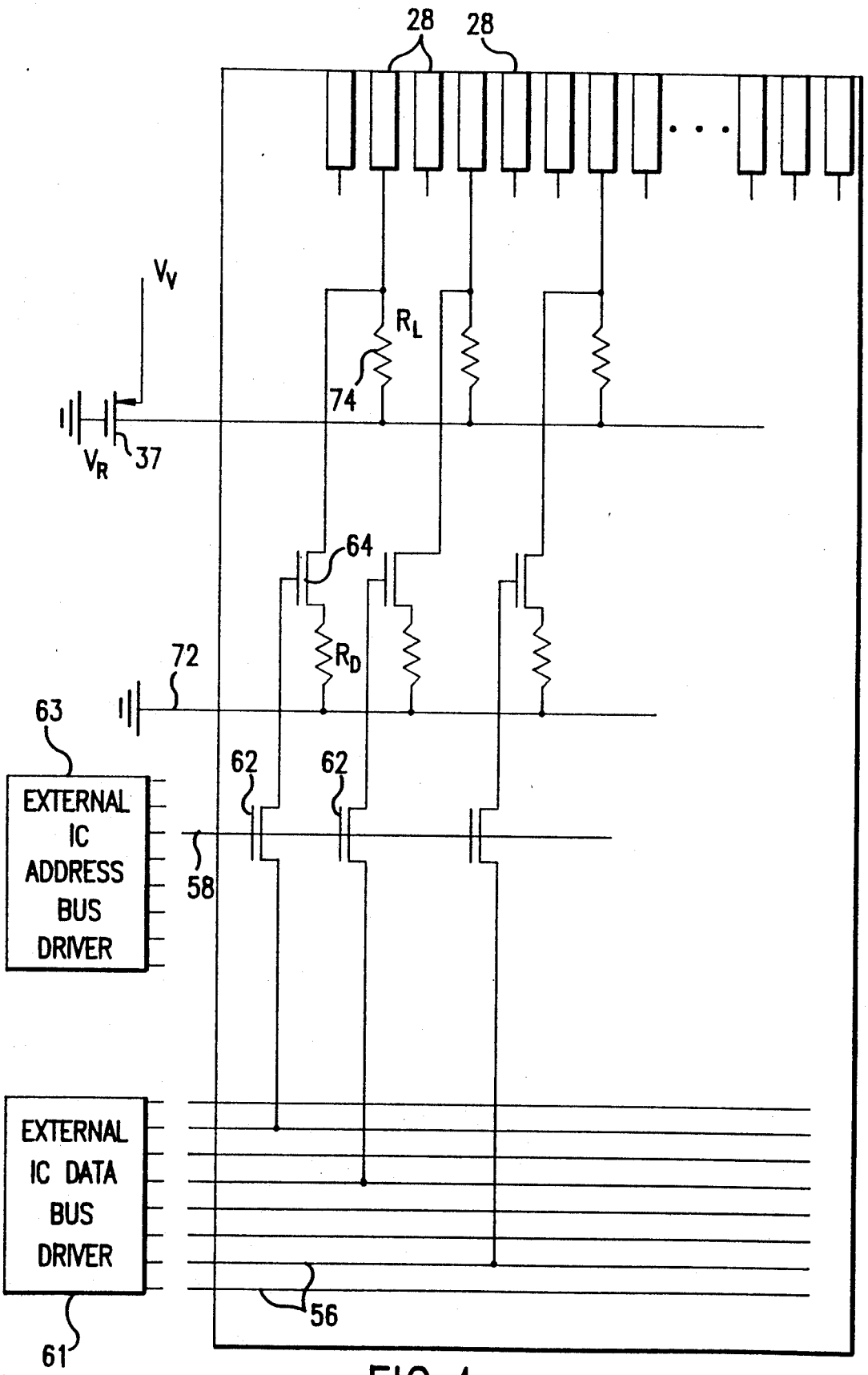
FIG. 4 is a schematic representation of one form of a marking head array of the present invention showing several modulation electrodes and their associated control circuits.

Once ions have been swept into modulation channel 24 by the transport fluid, it becomes necessary to render the ion-laden fluid stream intelligible. This is accomplished by individually switching modulation electrodes 28 in modulation channel 24, between a marking voltage source 36 at marking potential $V_M$ and a reference voltage source 37 at potential $V_R$ by means of a switch 38. While the switching arrangement shown produces a binary imaging function (that is, modulation electrodes have either a first voltage from marking voltage source 36 or a second voltage from reference voltage source 37 applied thereto), grey levels may be provided by providing a continuously variable voltage signal to the modulation electrodes. FIGS. 3 and 4, to be described below, show circuitry for applying a continuously variable modulation voltage to modulation electrodes 28, which extends between a first voltage level which causes substantially no ions to flow through channel 24 (adjacent that particular modulation electrode 28) and a second voltage level establishing a maximum ion flow density through channel 24, so as to permit grey scale writing to occur. The modulation electrodes are arranged as a thin film layer 40 supported on a planar insulating substrate 44 between the substrate and a conductive plate 46, and insulated from the conductive plate by an insulating layer 48.

Modulation electrodes 28 and the opposite wall 50, held at $V_H$, comprise a capacitor, across which the voltage potential of source 36 may be applied when connected through switch 38. Thus, an electric field, extending in a direction transverse to the direction of the transport fluid flow, is selectively established between a given modulation electrode 28 and the opposite wall 50.

"Writing" of a selected spot is accomplished by connecting a modulation electrode to the reference potential source 37, held at $V_R$, so that the ion "beam", passing between the electrode and its opposite wall, will not be under the influence of a substantial field therebetween. For example, if $V_R$ is equal to $V_H$, no field will exist in channel 24. Consequently, transport fluid exiting from the ion projector in that "beam" zone will carry the "writing" ions to accumulate on the desired spot of the image receptor sheet. Conversely, no "writing" will be effected when the modulation voltage from source 36 is applied to an electrode 28. This is accomplished by connecting the modulation electrode 28 to the voltage potential of source 36 via switch 38 so as to impose upon the electrode a charge of the same sign as the ionic species. For positive ions, the potential $V_M$ of source 36 is higher than $V_H$. The ion "beam" will be repelled and be driven into contact with the opposite, conductive wall 50 where the ions neutralize into uncharged, or neutral air molecules. It is not always desirable to have the value of $V_R$ equal to $V_H$ because it is not always necessary to permit ions to flow entirely unimpeded by any electric field through channel 24 even when maximum darkness of the final output image is desired. This is because too many ions may be deposited on a unit area of surface 31 rendering the output characters unintelligible. Additionally, if $V_R$ is slightly higher than $V_H$, ions flowing through channel 24 will be prevented from approaching electrodes 28, improving the lifetime of modulation electrodes 28. However, at high speeds of surface 31, a higher amount (or density) of ions can be permitted to flow through channel 24 because these ions will be deposited over a greater surface area of surface 31. Thus, it is common to use a value for $V_R$ (applied by voltage source 37) which differs from $V_H$ (applied by source 18 to wall 50) so that some ions in the stream of ions directed through channel 24 are not permitted to exit channel 24 in the final output stream, establishing a maximum ion flow density out of channel 24 and onto surface 31. When writing with grey scale, a range of voltages between $V_R$ and $V_M$ are selectively applied to modulation electrodes 28 so that the ion flow density which flows through channel 24 is within a range between a maximum flow rate and zero.

Thus, an imagewise pattern of information is formed by selectively controlling each of the modulation electrodes on the marking array so that the ion "beams" associated therewith either exit or are inhibited from exiting the housing, as desired. In the invention as described hereinbelow, and in most applications, it is highly desirable that the amount of ions that are deposited per unit area on surface 31 when a maximum flow rate is established is approximately constant so that uniform charging of surface 31 takes place. This can be accomplished by varying the ion flow density with variations in the velocity of surface 31 as described below.

The present invention continuously monitors the velocity of imaging surface 31 and controls marking head 10 so that areas of imaging surface 31 where intelligible patterns are to be formed are uniformly charged with ions. Since the instantaneous speed of imaging surface 31 varies from the average, or set, speed thereof, different portions of imaging surface 31 will be moving at different speeds when they pass channel 24 to have intelligible patterns formed thereon. In order to form final output images which have a uniform appearance, portions of the imaging surface which are to be developed into portions of the final image that are to have the same darkness level must have the same amount of charge per unit area formed thereon (i.e. must be uniformly charged). In other words, portions of the final image which are to have a maximum darkness must be formed by placing the same amount of charge per unit area (i.e., a maximum charge per unit area) on the appropriate portions of imaging surface 31. This maximum charge per unit area is maintained constant regardless of fluctuations in the speed of imaging surface 31 from the set speed by varying the maximum density of the stream of ions which is directed toward imaging surface 31 as the speed of imaging surface 31 varies. When imaging with grey scales, the darkness of portions of the final image are formed as some percentage (0%-100%) of the maximum darkness by controlling the the amount of charge per unit area formed on the appropriate portion of imaging surface 31. This is done by controlling the density of the stream ions directed toward imaging surface so that it is some percentage (between 0% and 100%) of the maximum density. Thus, by varying the maximum density of the stream of ions which can be directed toward imaging surface 31 based upon variations in the actual speed of imaging surface 31, portions of the imaging surface which are imaged at less than the maximum density (i.e., when imaging with grey scale) are also uniformly charged because these portions of the imaging surface 31 will always be exposed to a stream of ions which has a density which is some percentage of a maximum density which is appropriately adjusted with the speed of that portion of the imaging surface as it moves past channel 24. A number of exemplitive methods and apparatus for varying the maximum density of the ion stream will be set forth below.

As an alternative to an ionographic printing head with fluid jet assisted ion flow, it will no doubt be appreciated that other ionographic printheads may be provided where the ion stream could be field directed to the charge receptor, or directed to the charge receptor by a highly directionalized ion source. Further, while the description herein assumes positive ions, appropriate changes may be made so that negative ions may be used.

Various electrodes and biasing arrangements therefor, for the improvement of image quality and particularly for the reduction of blooming artifacts, have been proposed for placement adjacent to the ion stream path. These have little or no effect on the present invention, and are accordingly not described herein.

With reference again to FIG. 1, a motion encoder 120, which in the simplest case may be a rotary encoder that produces a series of pulses indicative of rotation, driven by movement of the imaging surface 34, directs such pulses to a counter 122, which upon detection of a predetermined number of pulses indicative of movement by an increment of one line width of print, produces a signal $V_E(t)$, indicative of movement of the charge receptor to a new position. Thus $V_E(t)$ is a pulse signal wherein each pulse represents movement of charge receptor to a new line position. $V_E(t)$ is directed to a writing controller 124 which analyzes signal $V_E(t)$ to determine the instantaneous velocity of imaging surface 31. The signal $V_E(t)$ is also passed on to machine controller 150, which also processes image input data and directs the modulation switching control to switch 38 so that the appropriate modulation electrodes 28 are controlled to either block or permit the passage of ion streams therethrough at each successive line position based on the image input data.

The manner in which the illustrated embodiment of the present invention determines the actual speed of the imaging surface 21 will now be described. Although the illustrated embodiment uses the pulse signal $V_E(t)$ to determine the actual imaging surface speed, it is understood that the pulse output from encoder 120 can be fed directly to writing controller 124 for use in determining the actual speed of imaging surface 31. In either case, the time which elapses between each pulse (which is directly related to the frequency of the signal output by encoder 120) is used to determine the velocity at which imaging surface 31 is actually moving. The actual speed of surface 31 is used, as described below, to control the maximum density of the stream of ions which is ultimately directed toward surface 31. Of course, a variety of motion encoding arrangements is available, including optical arrangements which detect passage of indicia imprinted on a surface of the charge receptor therepast. Other arrangements for detecting a predetermined amount of movement and producing a signal indicative thereof are not precluded by this disclosure.

Writing controller 124 derives an actual velocity signal representative of the actual velocity of imaging surface 31 at any instantaneous point in time. The actual velocity signal can in fact be the pulse signal output by encoder 120. A reference set velocity signal $V_S$ which represents the velocity at which imaging surface 31 is desired to be moving (i.e., the set velocity) is also input into writing control 124. For example, the set velocity $V_S$ could be a signal having a constant frequency which corresponds to the frequency which would be output by encoder 120 if imaging surface 31 were moving at the constant set speed. Writing controller 124 compares the actual velocity of imaging surface 31 with the set velocity $V_S$ which corresponds to the set speed of imaging surface 31 and outputs a velocity variance signal $V_V$ which represents the variance of the speed of imaging surface 31 from the set speed. A variety of circuits, well known to one of ordinary skill in the art, could be used for comparing the actual velocity signal with the set velocity signal $V_S$.

The speed variance signal $V_V$ is then used any number of ways to control the density of the ion stream which is ultimately directed toward imaging surface 31. Two such examples are illustrated in FIG. 1. In the first example, the speed variance signal $V_V$ is used to control the value of the referenc $V_R$ provided by voltage source 37. By varying the voltage provided by voltage source 37, the maximum density of the ion stream produced when switch 38 is attached to source 37 can be varied. For example, a look-up table can be provided which is used by writing controller 124, for example, to set the value of voltage source 37 based upon the set speed of imaging surface 31 and the variance of imaging surface 31 from the set speed. By controlling the voltage of source 37, as described above, the number of ions which are permitted to pass through channel 24 can be precisely controlled.

Alternatively, speed variance signal $V_V$ can be used to control the voltage $V_C$ which is supplied to coronode 14 from voltaqe source 16. This also has the effect of increasing or decreasing the maximum ion density which is supplied from channel 24. For example, a variable resistance 70 can be provided in series with voltage source 16 and can be varied based upon signal $V_V$ to increase or decrease the voltage applied to coronode 14 from a set voltage.

Other ways in which the ion density can be controlled include varying the amount of air flow provided by tube 22; varying the voltage applied by voltage supply 33 to shoe 32; and varying the current flow through the coronode wire. Additionally, a single electrode located at the exit of channel 24 and running the entire width of the head can be used to control the overall output level (e.g., the maximum ion flow density) as well.

Figure 2:
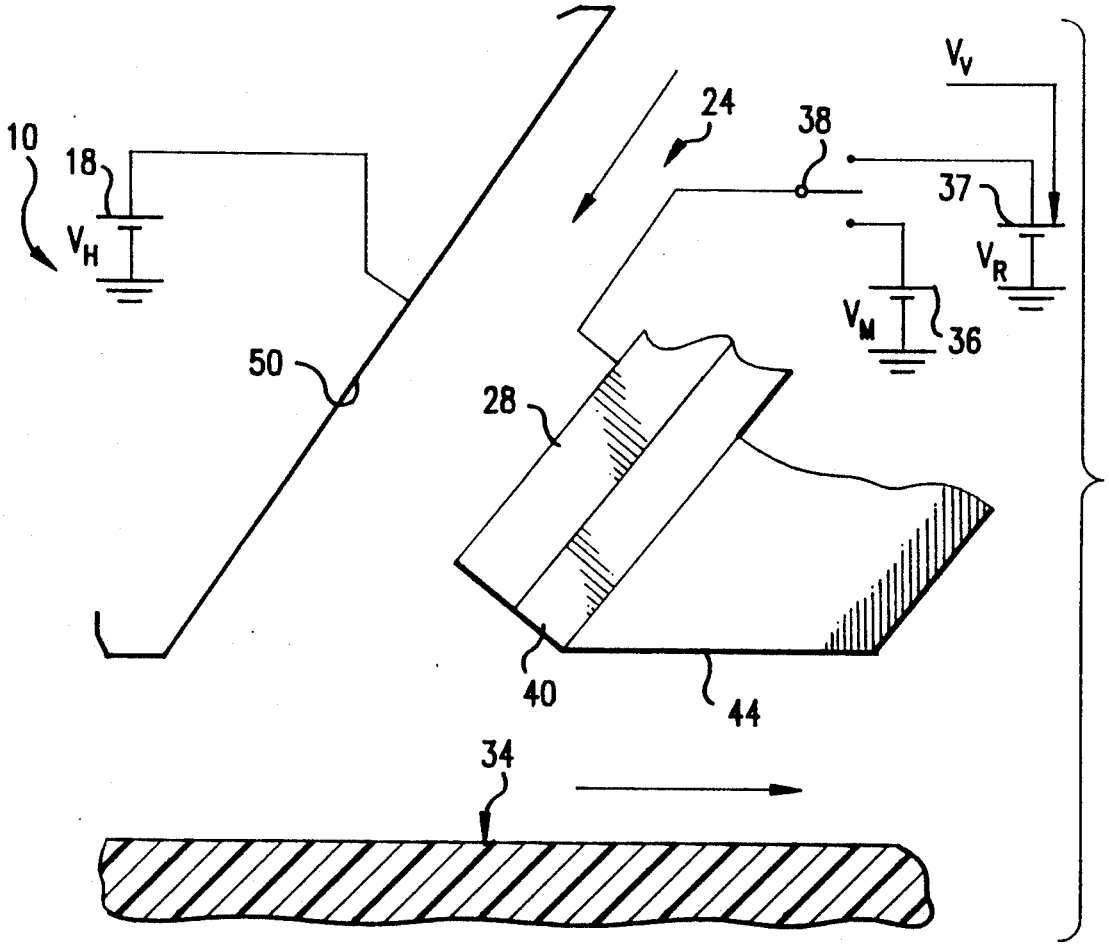
FIG. 2 schematically shows an embodiment of the invention in an ionographic printhead in which modulating electrodes are selectively actuatable between first and second voltage levels to provide a binary imaging function.

FIG. 2 is an enlarged partial view of the marking head 10 shown in FIG. 1. The marking head illustrated in FIGS. 1 and 2 is capable of printing in a binary manner. That is, the electrodes 28 are controlled to be either "on" or "off". When a modulation electrode 28 is "off", switch 38 is attached to voltage source 36 so that a first voltage, or marking voltage $V_M$, is applied to modulation electrode 28 which causes a field to be produced across channel 24 which is sufficient to block substantially all ion flow therethrough. When it is desired to permit ions to flow through channel 24 so as to apply a charge to imaging surface 34, switch 38 is attached to voltage source 37 so that the reference voltage $V_R$ is applied to modulation electrode 28. When reference voltage $V_R$ is applied to modulation electrode 28, a field is applied across channel 24 which is weaker than the field applied when switch contacts voltage source 36. This field blocks some of the ion flow through channel 24 but also permits a predetermined amount of ions to flow through channel 24 and become deposited on imaging surface 31. As discussed above, the amount of ions which flow through channel 24 is directly related to the potential of voltage source 37 which is varied from a set voltage based upon speed variance signal $V_V$. Thus, the arrangement illustrated in FIGS. 1 and 2 permits either substantially no ions to pass to imaging surface 31 or a maximum ion density to be directed to imaging surface 31, with the maximum ion density being varied based upon speed variance signal $V_V$.

FIGS. 3 and 4 schematically illustrate circuitry for providing a voltage potential to modulation electrodes 28 which is continuously variable between a first voltage level where no ions flow through channel 24 and a second voltage level establishing a maximum ion flow density through channel 24. This embodiment is generally similar to the previously described embodiment in that the reference voltage $V_R$ supplied by voltage source 37 which controls the maximum density of the ion stream which is directed to imaging surface 31 is varied using speed variance signal $V_V$. However, the arrangement schematically illustrated in FIGS. 3 and 4 also provides for grey scale imaging wherein the voltage supplied to modulation electrodes 28 can be continuously varied between the first and second voltages. This embodiment is somewhat similar to the invertor circuit printer head embodiment of FIG. 8 of U.S. Pat. No. 4,446,163 to Tuan et al, and thus will not be discussed in great detail.

The amplification circuit shown in FIGS. 3 and 4 permits an analog signal supplied from machine controller 150 to be applied to modulation electrodes 28 to provide for grey scale. In particular, an analog signal supplied from machine controller 150 is supplied to a high voltage output stage after passing through low voltage FET (field effect transistor) 62 when FET 62 is switched ON by having an appropriate voltage applied to its gate via line 58. The modulation electrode 28 is connected to a variable high voltage source 37 via a load resistor 74 and to ground through drain line 72 of high voltage FET 64 which has a drain resistance $R_d$. FET 64 has an equivalent gate capacitance Cg which is appropriately selected. The gate of transistor 64 is, in turn, connected to the machine controller 150 and, accordingly receives the analog signal therefrom when low voltage FET 62 is switched ON.

In operation, referring to FIGS. 3 and 4, the array of modulation electrodes 28 is divided into a number of groups. The low voltage FET 62 of all the electrodes 28 of each group is attached to a bus driver line 58, which is common to all of the transistors 62 of its corresponding group of electrodes 28. Accordingly, External IC Address Bus Driver 63 applies an address signal to each of the bus driver lines emanating therefrom, one at a time, so as to switch ON all of the transistors 62 in a group, one group at a time. External IC Data Bus Driver 61 includes a plurality of data lines 56, each data line 56 being attached to one transistor 62 (and consequently one modulation electrode 28) in each group. Accordingly, as each group of transistors 62 is switched ON, each transistor 62 in that group is supplied with a data signal, which is an analog signal, via data line 56. The analog signal represents the grey scale level of the pixel image to be formed by a corresponding modulation electrode 28. That is, the analog signal represents a value, between 0% and 100%, of a maximum darkness value of the pixel image to be formed by an electrode 28.

The analog signal provided by a data line 56 is supplied to the gate of a high voltage FET 64 and controls the amount which that FET is switched ON. That is, analog signal can continuously vary the amount of current which will flow through FET 64. By continuously varying the amount of current which flows through FET 64, the voltage which is applied from source 37 to modulation electrode 28 can be continuously varied. When FET 64 is OFF and permits no current to flow therethrough, the entire voltage from source 37 (as controlled by load resistor $R_L$) is applied to the electrode 28 to deflect a maximum number of ions in the channel 24 adjacent thereto so that substantially no ions are permitted to flow to surface 31. When FET 64 is switched entirely ON, a maximum amount of current will flow therethrough (which maximum amount of current is controlled by the values of $R_L$, $R_d$ and Cg), to cause a stream of ions having a maximum ion density to be directed toward surface 31. Varying the degree to which FET 64 is turned ON varies the voltage applied to electrode 28 between these two extremes, thus providing grey scale.

As stated earlier, by varying the value of voltage $V_R$ supplied by source 37 based upon speed variance signal $V_v$, the maximum ion flow density can be varied. While varying the voltage of source 37 results in varying the voltage applied to electrode 28 at all levels of grey scale (i.e., the first voltage applied to electrode 28 when FET 64 is entirely OFF changes as $V_R$ changes, the second voltage applied to electrode 28 when FET 64 is entirely ON changes as $V_R$ changes, and all voltages between the first and second voltages change as $V_R$ changes), the values of $R_L$, $R_d$ and Cg are chosen so that the first voltage is always sufficient to cause substantially no ions to flow toward surface 31. Thus, any change which is caused in the value of the first voltage (the blocking voltage) is inconsequential. However, as described above, varying the second voltage (and thus, the range of voltages which can be applied to electrode 28) as the speed of imaging surface 31 fluctuates, results in uniform charging of the imaging surface and thus uniform quality of the output image.

Figure 5:
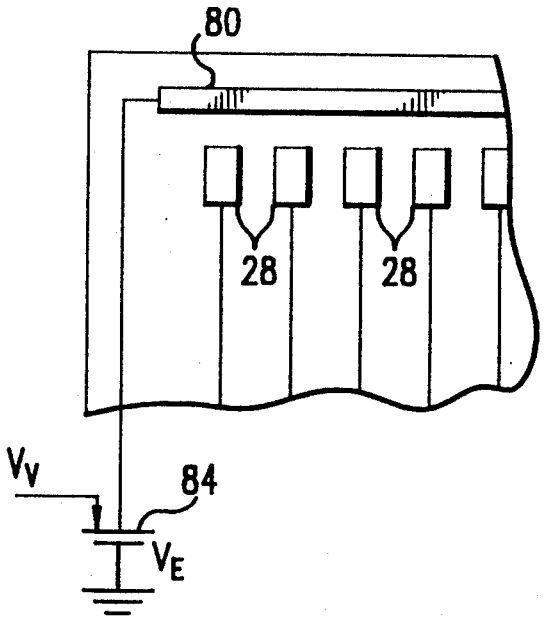
FIG. 5 is a schematic representation of another marking head according to the present invention wherein an exit electrode which extends along the entire width of the marking head is used to control the overall output level of ions from the marking head.

FIG. 5 schematically illustrates an alternative manner in which the ion flow density can be controlled. In the FIG. 5 embodiment, an exit electrode 80 is provided with a voltage potential $V_E$ from source 84, which potential $V_E$ is varied based on speed variance signal $V_V$. Each of the modulation electrodes 28 are controlled in either binary or continuous fashion, as described above, to render individual streams of ions intelligible. However, the maximum ion flow density capable of being output by the marking head (and all flow densities between zero and the maximum density when gray scale is used) is controlled with exit electrode 80. Exit electrode 80 functions somewhat like the gating electrode illustrated in FIGS. 1, 2, 4 and 5A of the above-incorporated U.S. Pat. No. 5,018,476, except the voltage applied to exit electrode 80 is not sufficient to entirely block flow out of channel 24 (as does the gating electrode in U.S. Pat. No. 5,081,476, but instead deflects a percentage of the ions which are permitted to pass by modulation electrodes 28, based upon fluctuations in the speed of imaging surface 31 so that the output image has a uniform quality. Accordingly, the voltage $V_E$ is varied from a set voltage which corresponds to the set speed based upon speed variance signal $V_V$.

Figure 6:
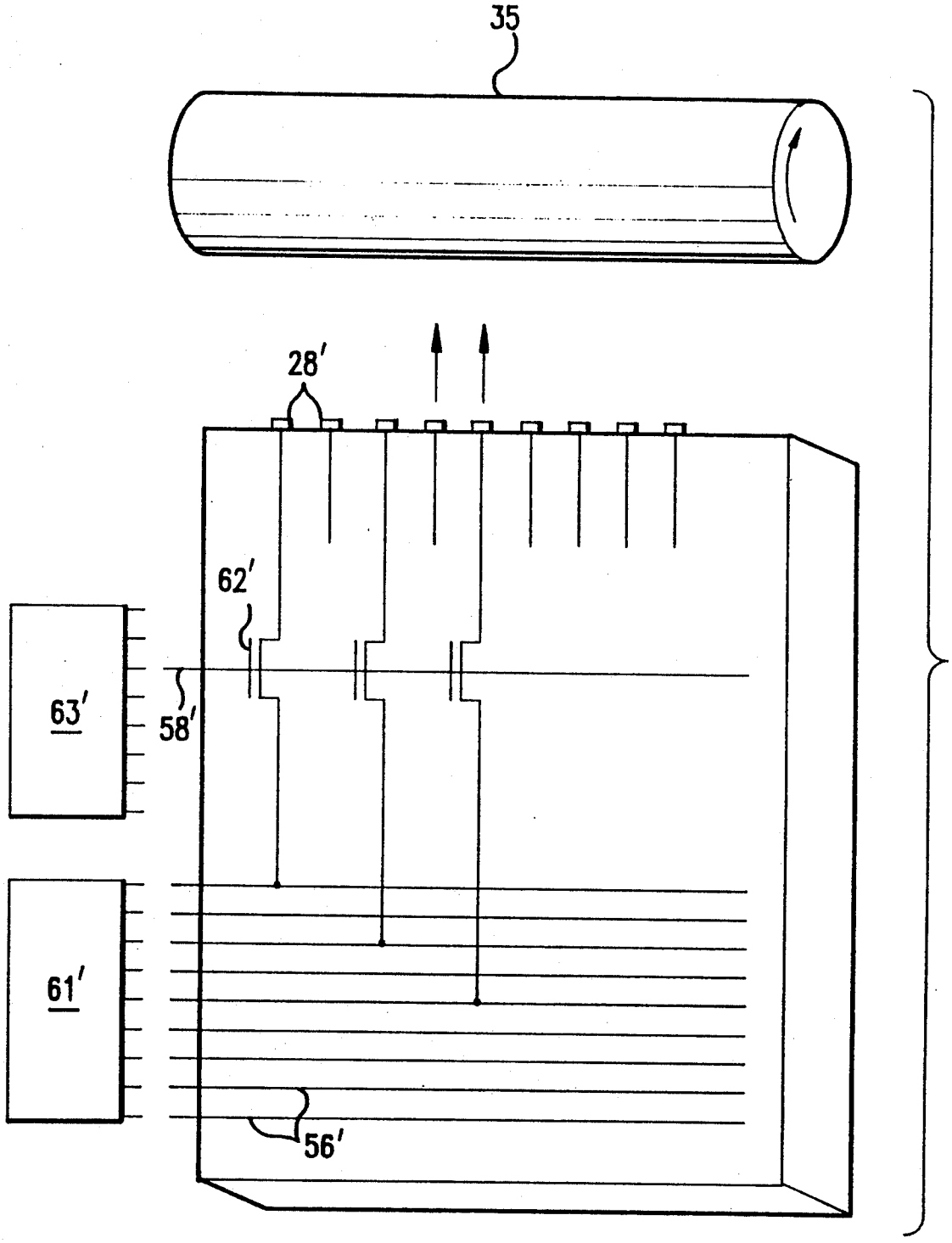
FIG. 6 is a schematic representation of another form of a marking head array of the present invention showing several LED's and their associated control circuits.

FIG. 6 schematically illustrates an imaging device which selectively controls a plurality of light emitting diodes (LED's) 28' to direct light towards and form a latent image on the photoreceptive surface of drum 35. The manner in which light is used to form latent images on a photoreceptive surface is well known in the art and thus will not be described in any greater detail. Additionally, the use of LED's having a variable output intensity level is also well known in the art (for gray scale printing), and need not be further described. The present invention controls the intensity of light emitted by each individual LED 28' based upon the difference between the actual rotating speed of drum 35 and the set speed for rotation of drum 35 in a manner similar to that described above with reference to the ionographic marking head. Each LED 28' has its own addressing transistor 62' which is used to supply a variable voltage to its corresponding LED 28' to control the intensity of the light emitted thereby. A plurality of external integrated circuit address bus driver lines 58' are provided, each line 58' being attached to a group of adjacent LED's. An external IC address bus driver 63' is provided and is used to turn on all of the transistors 62' in each group of LED's 28', one group at a time. A plurality of data bus driver lines 56' are provided, with each line 56' being attached to one transistor 62' in each group of transistors. External integrated circuit data bus driver 61' controls the amount of current which is applied through each transistor 62' when turned on to thus control the intensity of light emitted from its respective LED 28'.

While the present invention is described with reference to a particular embodiment, this particular embodiment is intended to be illustrative, not limiting. For example, the present invention is also applicable to imaging devices which form a latent image on a photoreceptive drum by reflecting a beam of light off of an original document and onto the photoreceptive drum to selectively discharge portions of the drum. In this case, the intensity of a light source which produces the beam of light would be varied from a set intensity by varying the voltage supplied thereto based upon the speed variance signal. The present invention can be used in ionographic imaging devices which perform "reflex printing" and also in combination with the "gating electrodes" disclosed in the above-incorporated U.S. Pat. No. 5,018,476. Various modifications may be made without departing from the spirit and scope of the invention as defined in the appended claims.

What is claimed is:

1. An ionographic imaging device comprising:

a movable electroreceptive imaging surface capable of having an image pattern formed thereon by application of an ion stream thereto;

means for moving said imaging surface at a substantially constant set speed;

means for detecting incremental motion of the imaging surface, and producing an actual motion signal indicative thereof;

a source of ions;

means for directing an ion stream from said source of ions towards said imaging surface to create an image thereon;

means for modulating the ion stream in imagewise fashion to form intelligible patterns on said imaging surface; and means for controlling an intensity at which said ion stream is directed towards said imaging surface based upon a difference between a signal representing the set speed and the signal produced by said means for detecting incremental motion of the imaging surface, so that a density of the ion stream directed to the imaging surface is varied so that a number of ions deposited on the imaging surface per unit area of the imaging surface is substantially constant where said intelligible patterns are formed on said imaging surface.

2. The imaging ionographic device of claim 1, wherein said means for controlling includes:

means for determing a speed variance of said imaging surface from said set speed by comparing said actual motion signal to a set motion signal which corresponds to said set speed, and producing a speed variance signal; and means for varying the density of said ion stream directed towards said imaging surface from a set density which corresponds to said set speed, based upon said speed variance signal.

3. The iongraphic imaging device of claim 1, wherein said source of ions includes:

an ion chamber maintained at a first voltage potential;

a coronode located in said ion chamber;

means for applying a voltage to said coronode; and means for forming an ion stream which is directed out of said ion chamber toward said imaging surface;

wherein said means for controlling controls the means for applying a voltage to said coronode so that the density of the stream of ions causes areas of said imaging surface where said intelligible patterns are formed to be uniformly charged with ions.

4. The ionographic imaging device of claim 3, wherein said means for controlling further includes:

means for determining a speed variance of said imaging surface from said set speed by comparing said actual motion signal to a set motion signal which corresponds to said set speed, and producing a speed variance signal; and means for varying the voltage applied to said coronode from a set voltage which corresponds to said set speed, based upon said speed variance signal.

5. The ionographic imaging device of claim 1, wherein said means for modulating the ion stream modulates said stream of ions in imagewise fashion to form intelligible charge patterns on said imaging surface, said means for modulating applying a modulating voltage across a channel which extends between said source of ions and said imaging surface to control the density of said stream of ions directed to said imaging surface, said modulating voltage being selectable within a range between first and second voltage levels, said first voltage level causing no ions to flow through said channel and said second voltage level establishing a maximum ion flow density through said channel;

wherein said means for controlling controls a value of said second voltage level so that said maximum ion flow density causes areas of said imaging surface exposed thereto to be uniformly charged with ions.

6. The ionographic imaging device of claim 5, wherein said means for controlling further includes:

means for determining a speed variance of said imaging surface from said set speed by comparing said actual motion signal to a set motion signal which corresponds to said set speed, and producing a speed variance signal; and means for varying said second voltage level from a set second voltage level which corresponds to said set speed, based upon said speed variance signal.

7. The ionographic imaging device of claim 1, wherein said means for modulating the ion stream in imagewise fashion includes an array of modulation electrodes arranged in a passage, located between said source of ions and said electroreceptor, said array of modulation electrodes extending generally across a path of said stream of ions, each of said modulation electrodes being individually biasable to modulate the ion stream flowing therepast in imagewise fashion; and wherein said means for controlling includes:

an exit electrode, located in said passage, extending generally across said path of said stream of ions; and means for applying a voltage to said exit electrode to selectively block a percentage of the ion flow through said passage so that the density of the stream of ions causes areas of said imaging surface where said intelligible patterns are formed to be uniformly charged with ions.

8. The ionographic imaging device of claim 7, wherein said means for controlling further includes:

means for determining a speed variance of said imaging surface from said set speed by comparing said actual motion signal to a set motion signal which corresponds to said set speed, and producing a speed variance signal; and means for varying the voltage applied to said exit electrode from a set voltage which corresponds to said set speed, based upon said speed variance signal.

9. An ionographic imaging device comprising:

a body having an ion chamber formed therein, and including an inlet passage to the chamber and an outlet passage from the chamber;

a source of ions supported within said chamber;

a fluid jet source, supplying a moving stream of fluid through said inlet, past said ion source, and entraining ions produced therat to be carried through said outlet passage;

a movable charge retentive imaging surface, located adjacent and movable past said outlet passage for receiving ions to create a pattern of charge thereon;

means for moving said imaging surface past said outlet passage at a substantially constant set speed;

means for sensing incremental movement of the imaging surface and for producing an actual motion signal indicative thereof;

an array of modulation electrodes arranged at said outlet passage generally transversely across a path of the moving stream of fluid, and individually biasable to modulate the ion stream flowing therepast in imagewise fashion for the formation of intelligible charge patterns on the imaging surface; and means for controllign a maximum density at which said ion stream is directed toward said imaging surface based upon a difference between a signal representing the set speed and the signal produced by said means for detecting incremental motion of the the imaging surface, so that areas of said imaging surface contacted by said ion stream at said maximum density are uniformly charged so as to be coated with a substantially constant number of ions per unit surface area of said imaging surfae regardless of fluctuations in the seed of said imaging surface from said set speed.

10. The ionographic imaging device of claim 9, wherein said means for controlling includes:

means for determining a speed variance of said imaging surface from said set speed by comparing said actual motion signal to a set motion signal which corresponds to said set speed, and producing a speed variance signal; and means for varying the density of the stream of ions produced by said source of ions from a set density which corresponds to said set speed, based upon said speed variance signal.

11. The ionographic imaging device of claim 9, wherein said source of ions is a coronode supported within said ion chamber and further comprising:

means for applying a voltage to said coronode;

wherein said means for controlling controls the means for applying a voltage to said coronode so that the maximum density of the stream of ions varies with fluctuations in the speed of said imaging surface from said set speed.

12. The ionographic imaging device of claim 9, wherein each of said modulation electrodes is biasable to a modulating voltage, said modulating voltage being selectable within a range between first and second voltage levels, said first voltage level causing no ions to flow past said respective modulation electrode and said second voltage level establishing said maximum density at which said ion stream is directed past said respective modulation electrode; wherein said means for controlling controls a value of said second voltage level so that said maximum density of the stream of ions varies with fluctuations in the speed of said imaging surface from said set speed.

13. The ionographic imaging device of claim 9, wherein said means for controlling includes:

an exit electrode, located in said passage, extending generally across said path of said stream of ions; and means for applying a voltage to said exit electrode to selectively block a percentage of the ion flow through said passage so that the density of the stream of ions causes areas of said imaging surface where said intelligible patterns are formed to be uniformly charged with ions.

14. A method of conrolling an intensity of an ion stream which is directed toward an electroreceptive imaging surface in an ionographic imaging device including means for directing the ion stream towad the imaging surface as the imaging surface is moved at a substantially constant set speed, and means for imagewise modulating the ion stream between minimum and maximum intensities to form intelligible character patterns on said imaging surface, including the steps of:

detecting fluctuations in the speed at which said imaging surface is moved from said set speed; and varying the maximum intensity of said ion stream by varying a density of the ion stream from a set maximum density which corresponds to said set speed based on said detected speed fluctuation so that areas of said imaging surface which are exposed to said maximum density of said ion stream are coated with a substantially constant number of ions per unit area of said imaging surface regardless of said speed fluctuations.

15. The method of claim 14, wherein said imaging device includes an ion chamber maintained at a first voltage potential, a coronode located in said ion chamber, means for applying a voltage to said coronode, and means for directing said stream of ions out of said ion chamber, wherein the maximum ion density is controlled by controlling said voltage applied to said coronode.

16. The method of claim 15, wherein said voltage applied to said coronode is controlled by varying said voltage from a set coronode voltage which corresponds to said set speed based upon said detected speed fluctuations of said imaging surface from said set speed.

17. The method of claim 14, wherein said imaging device includes a source of ions, means for directing said stream of ions from said source of ions through a passage to said electroreceptive material, and an array of modulation electrodes arranged in said passage generally across a path of said stream of ions, each of said modulation electrodes being individually biasable to modulate the ion stream flowing therepast in imagewise fashion for the formation of intelligible charge patterns on the imaging surface, said modulating electrodes being biasable between a first voltage level where substantially no ions flow therepast and a second voltage level to establish said maximum density of said ion stream;

wherein said maximum density is varied by varying said second voltage level from a set second voltage level corresponding to said set speed, based upon said detected fluctuations.

* * * * *